US006113025A

United States Patent [19]

Kudrus

[11] Patent Number: 6,113,025

[45] **Date of Patent: *Sep. 5, 2000**

[54] COIL HOLDER FOR AT LEAST ONE COIL HAVING A DISPLACING ELEMENT WHICH MOVES CLAMPING ELEMENTS BETWEEN A CLAMPING POSITION AND A RELEASING POSITION

[75] Inventor: Heiner Kudrus, Barmstedt, Germany

[73] Assignee: Neumag-Neumünstersche Maschinen- und Anlagenbau GmbH, Neumünster, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/730,335

[22] Filed: Oct. 15, 1996

[30] Foreign Application Priority Data

Oct. 13, 1995 [DE] Germany ..... 195 38 262

[51] Int. Cl.[7] ..... B65H 75/24; B23B 31/16

[52] U.S. Cl. ..... 242/573.7; 242/573.2; 242/576.1; 279/2.1

[58] Field of Search ..... 242/573.2, 573.7, 242/576.1; 279/2.09, 2.1, 2.11, 2.12, 2.15, 2.2, 2.23; 269/48.1

[56] References Cited

U.S. PATENT DOCUMENTS

| | | | |
|---|---|---|---|
| 537,789 | 4/1895 | Sinclair | 242/573.2 |
| 596,326 | 12/1897 | Hawkins | 242/573.2 |
| 1,316,709 | 9/1919 | Gray | 279/2.15 X |
| 2,080,906 | 5/1937 | Boyer | 269/48.1 |
| 2,293,085 | 8/1942 | Stieber | 279/2.12 X |
| 2,352,912 | 7/1944 | Parker | 279/2.09 X |
| 2,555,170 | 5/1951 | Wall | 279/2.09 |
| 2,616,633 | 11/1952 | Reynolds . | |
| 2,766,532 | 10/1956 | Eisele | 279/2.12 X |
| 3,782,740 | 1/1974 | Peyrot | 279/2.23 |
| 4,210,294 | 7/1980 | Jansen | 242/576.1 X |
| 4,712,720 | 12/1987 | Tesch | 269/48.1 X |
| 4,767,077 | 8/1988 | Kataoka | 279/2.2 X |
| 5,645,246 | 7/1997 | Sugioka et al. | 242/573.7 |

FOREIGN PATENT DOCUMENTS

| | | | |
|---|---|---|---|
| 0636565A1 | 7/1994 | European Pat. Off. . | |
| 1140424 | 11/1962 | Germany | 242/573.2 |
| 1873538 U | 3/1963 | Germany . | |
| 2106493B2 | 1/1979 | Germany . | |
| 2719853B2 | 6/1979 | Germany . | |
| 3044315A1 | 10/1981 | Germany . | |
| 3039064A1 | 9/1982 | Germany . | |
| 4335258A1 | 4/1995 | Germany . | |
| 4335259A1 | 4/1995 | Germany . | |
| 59-14409 | 1/1984 | Japan | 279/2.12 |
| 617173 | 7/1978 | U.S.S.R. | 279/2.23 |
| 1745656 | 7/1992 | U.S.S.R. | 242/573.2 |

*Primary Examiner*—Daniel P. Stodola
*Assistant Examiner*—Gregory J. Strimbu
*Attorney, Agent, or Firm*—Michael J. Striker

[57] ABSTRACT

A coil holder for one or several coils arranged one after the other has a main pipe having an outer periphery provided with recesses forming abutment surfaces which are wedge-shaped in an axial direction of the main pipe, a plurality of clamping elements arranged in groups axially arranged one behind the other and each distributed on a circumferential line of the main pipe so as to partially engage in the recesses in the outer periphery of the main pipe, a cylindrical displacing element surrounds the main pipe, a device for displacing the displacing element, the displacing element being formed as a displacing pipe which surrounds at least two of the groups of the clamping elements, the recesses of the main pipe being limited in a circumferential direction and having a width substantially equal to a width of the clamping elements and the displacing element includes openings through which the clamping elements are adapted to extend to hold the coil or several coils on the main pipe.

8 Claims, 12 Drawing Sheets

1
2
3
4
5
6
7
8
9
10
11
12
13
14
15
16
17
18
19
20
21
22
23
24
A
B

COIL HOLDER FOR AT LEAST ONE COIL HAVING A DISPLACING ELEMENT WHICH MOVES CLAMPING ELEMENTS BETWEEN A CLAMPING POSITION AND A RELEASING POSITION

BACKGROUND OF THE INVENTION

The present invention relates to a coil holder for one or several coils arranged one after the other.

For obtaining a high winding speed, the coil holder must have a maximum possible rigidity. These requirements can be satisfied only with a suitable clamping system.

The German document DE-C 30 39 064 discloses a clamping chuck in coil machines for receiving a coil support, a rotatable clamping mandrel, a casing with throughgoing openings for radial passage of a corresponding clamping element, a plurality of clamping elements, and displacing elements arranged in the intermediate space between the clamping mandrel and the casing for displacing the clamping element, as well as a part of a device for displacing the displacing element. The clamping elements are provided with the surfaces which are wedge-shaped in an axial direction. Along these surfaces, they are axially displaceable on corresponding counter surfaces of the displacing element and thereby simultaneously move radially. The clamping is performed by a device for displacing the displacing element with springs which act on the displacing elements and are compressed for unclamping by pressure air.

In the construction disclosed in this reference, the rigidity of the coil holder is determined by the clamping mandrel. A high rigidity of the coil support requires a predetermined diameter of the clamping mandrel. Since relatively great space is needed for the intermediate space with the clamping elements and means for displacing the clamping elements and the casing, the outer diameter of the clamping mandrel is small relative to the inner diameter of the coil to be clamped. A high rigidity of the coil holder is therefore not obtained with this system.

The German Document DE-B 27 19 853 described a coil holder with a rotatable main pipe, a casing sleeve provided with openings for clamping elements and with clamping elements arranged therebetween, cages for radial movement of the clamping elements and a part of a device for moving the cages, which however is not suitable for high winding speeds. This reference also discloses the use of cylindrical rollers which have axes extending parallel to the rotary axes and are formed as clamping elements.

The German Patent Document DE-A 43 35 258, DE-A 43 35 259 and DE-A 30 44 315 disclose coil holders with supporting pipes which increase the rigidity of the coil holders. These supporting pipes are provided with throughgoing openings for clamping elements. The clamping elements, as disclosed for example in the patent document DE-A 43 35 258, are distributed in groups uniformly on an outer peripheral line of the supporting pipe and arranged so as to move radially outwardly. Elements for moving the clamping elements are located inside the supporting pipe, and an axial displacement on the wedge surfaces leads to a radial displacement of the clamping element. The clamping device disclosed in the German document DE-A 43 35 258 performs the clamping and unclamping by means of a spring force and the pressure air, the clamping system described in the patent document DE-A 43 35 259 performs the clamping and unclamping by means of a central threaded rod, and the clamping device disclosed in the German patent document DE-A 30 44 315 performs the clamping and unclamping by means of a flat pulling rod.

In these coil holders, the rigidity with the predetermined outer diameter of the coil holder or in other words the supporting pipe is still low. For obtaining a greater rigidity, a predetermined wall thickness of the supporting pipe is needed. This is true especially since the supporting pipes are provided with many openings for the clamping elements. Moreover, a certain space for the means for displacing the clamping element inside the supporting pipe is needed.

The European patent document EP-A 06 36 565 discloses a coil holder with higher rigidity. The coil holder has a rotatable main pipe which determines the rigidity and is provided with axially arranged ring-shaped recess. Clamping elements are distributed on a peripheral line in the recesses and are inserted with a part in the recesses. Here also a radial displacement of the clamping element is performed by an axial displacement on wedge-shaped surfaces. In this reference, the web-shaped surfaces are formed by the clamping elements and the supporting surfaces of the recess. The axial displacement of the clamping elements is performed by means of displacing sleeves which are arranged on the main pipe axially one behind the other and for example connected with one another. They are provided with openings for the clamping elements. The clamping is performed by means of a spring force, and in addition to the spring arresting the displacing sleeve, a spring is provided with each clamping element.

A further coil holder in which the clamping elements are partially arranged in the recesses of a main roll is disclosed in the German document DE-A 21 06 493. The wedge-shaped supporting surfaces of the recesses of the main pipe extend in a peripheral direction. For a radial movement of the clamping element, a basket surrounds the main pipe and is provided with openings, to hold the clamping element by prestressed springs in the clamping position. In this coil holder the main pipe is weakened by recesses which extend a circumferential direction and occupy approximately 90% of the periphery, as well as by further recesses for the springs which prestress the cage. The coil holder does not have a sufficient rigidity to be used with high winding speeds. Moreover, in this clamping system a reliable, fast acceleration and breaking is not guaranteed.

SUMMARY OF THE INVENTION

Accordingly, it is an object of present invention to provide a coil holder for one or several coils, which avoids the disadvantages of the prior art.

In keeping with these objects and with others which will become apparent hereinafter, one feature of present invention resides, briefly stated in a coil holder in which the displacement elements are formed as displacement pipes which are rigidly connected with one another and surround at least two groups of the clamping elements, and the recesses of the main pipe are limited in a circumferential direction and have a width corresponding to the width of the clamping element.

When the coil holder is designed in accordance with the present invention, it can move with approximately 2000 revolutions per minute higher winding speed than the conventional coil holder. Higher winding speeds are possible on the one hand by the recesses which are limited in the circumferential direction to the width of the clamping element and thereby provide increased rigidity for the main pipe. The limiting of the width of the recesses of the main pipe has also the advantage that the coil holder is rotation-secure during acceleration and breakings.

An increase of the winding speed is also possible by the formation of the displacing pipes which are rigidly connected with one another and correspondingly engage two groups of the clamping elements through openings. The arrangement of individual springs which hold the clamping elements in a clamping position in addition to the clamping elements in the recesses of the main pipe is no longer necessary. In the inventive coil holder the clamping elements are held in the clamping position by the displacing pipes.

Since the individual springs for the clamping elements are dispensed with, the recesses of the main pipe can be shorter in the axial direction, which leads to a further increase of the rigidity of the main pipe. The danger of unbalance during high winding speeds by parts of the clamping system is reduced since there are no springs.

The coil holder with the new features in accordance with the present invention provides for high angular speeds because of a uniform, central clamping of the sleeves. During clamping, the clamping elements are moved from a definite initial position by simultaneous axial displacement of all clamping elements by means of displacement of the displacing pipe, to a definite radial position. This leads to a more uniform, centered clamping of the sleeves than in the known coil holders, in which the clamping elements are moved by displacement of the displacing sleeves to the clamping position and arrested by the individual springs in the clamping position.

Finally, in the inventive coil holder the unbalance produced during winding is better absorbed than in the known coil holders in which a greater force occurring at the clamping element is possible for moving the clamping element against the force of the individual spring. In the inventive coil holder a movement of an individual clamping element is not possible. Only all clamping elements can be moved simultaneously, therefore the force which holds the displacing pipe and all clamping elements in clamping position must be overcome.

In accordance with another feature of the present invention, one rigid displacing pipe surrounds all clamping elements. As a result, a low number of components is needed. In accordance with still another feature of the present invention, the outer surfaces of the clamping element perpendicular to the rotary axis of the main pipe are round. The clamping elements can be formed as balls or cylindrical rollers which, in contrast to the constructions disclosed in the German document DE-B 27 19 853 and DE-A 21 06 493, are arranged with their axes perpendicular to the rotary axis. During displacement of the clamping elements, they roll on the supporting surfaces of the recesses of the main pipe, and only a low rolling friction must be overcome instead of a sliding friction. Moreover, the balls and cylindrical rollers are easily available parts which are therefore inexpensive.

In accordance with a further feature of present invention, the clamping elements are formed as hollow cylinders, and a safety wire is arranged through the hollow cylinders of one group of clamping elements on a periphery of the main pipe. Since the clamping elements are formed as hollow cylinders, they are easy to manufacture, light and thereby suitable for high winding speeds. A safety wire prevents the clamping elements from falling out of the openings of the displacing pipe. The cylindrical clamping elements have the advantage that with the use of cardboard sleeves during clamping, their end sides are pressed substantially into the sleeve and form a non-rotatable coil holder. With the thusly non-rotatable coil holder it is easier to make fast acceleration and breaking.

In accordance with still a further feature of present invention, the clamping elements are formed as balls. Therefore, they are easily available. Moreover, with the use of balls the clamping elements can be made especially small. Thus the recesses of the main pipe can have a low depth and therefore the coil holder has a high rigidity. The clamping elements formed as balls of one group can be provided with a metal ring extending in a groove of the displacing pipe and having an outer diameter corresponding to that of the displacing pipe.

As a result, in unclamped condition there is a substantially smooth surface of the coil holder without danger of caught threads. In clamped condition, the metal ring is polygonally deformed by the radially outwardly movable balls and leads also to a rotation-secure coil holder because of its flat surface pressing into the cardboard sleeve.

In a still further embodiment of the invention, the clamping elements can be formed as pins with a collar facing the main increase, and with springs provided between the collar and the corresponding ring groove at the edge of the openings of the displacing pipe. The sliding pins are also easily available. A spring between the collar and the ring groove at the inner end of the openings of the displacing pipe presses the clamping elements onto the main pipe and prevents in an unclamped condition a movement of the sliding pin out due to its weight.

The supporting surface of the recesses can have two portions which are located one after the other in an axial direction, and the pitch in the clamping direction of the front portion of the clamping direction is greater than the pitch of the rear portion. In this construction an overcoming of the path of the clamping element between the outer diameter of the displacing pipe and the inner diameter of the sleeve is performed in a shorter space due to the greater increase of the forward portion.

The clamping of the sleeve by the clamping element is performed with a low increase of the supporting surface. Since the clamping action of the clamping element is greater with the lowering of the increase of the recess, a great clamping action is provided in the clamping region.

In accordance with still another feature of the present invention, the housing-side end of the displacing pipe which is the rearmost in the clamping direction has a collar, and the device for displacing the displacing pipe has an injection plate mounted on an injection rod for at least partially closing the displacing pipe before the collar. The ejecting plates are known in all older coil holders for removal of the sleeves. For clamping, the displacing pipe is axially displaced by the ejecting plate which is movable to the housing or in other words in the clamping direction and engages the collar of the displacing pipe. The unclamping is performed by displacement of the sleeve by the ejecting plate from the housing and taking the displacing pipe along. The formation of the ejecting ring as means for displacing the displacing pipe simplifies the construction of the coil holder further and contributes to high winding speed.

In accordance with another feature of present invention, the device for displacing the displacing pipe has arresting elements which are inserted in the main pipe and associated with two grooves arranged one behind the other on the inner periphery of the displacing pipe. The arresting elements associated with the recesses in the displacing pipe secure the position of the displacing pipe in the clamping position and in the unclamping position.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

In accordance with a first embodiment, a coil holder for a coil has a rotatable main pipe 1, a clamping element 2, a displacing pipe 3 as well as a device for displacing the displacing pipe 3.

Figure 1:
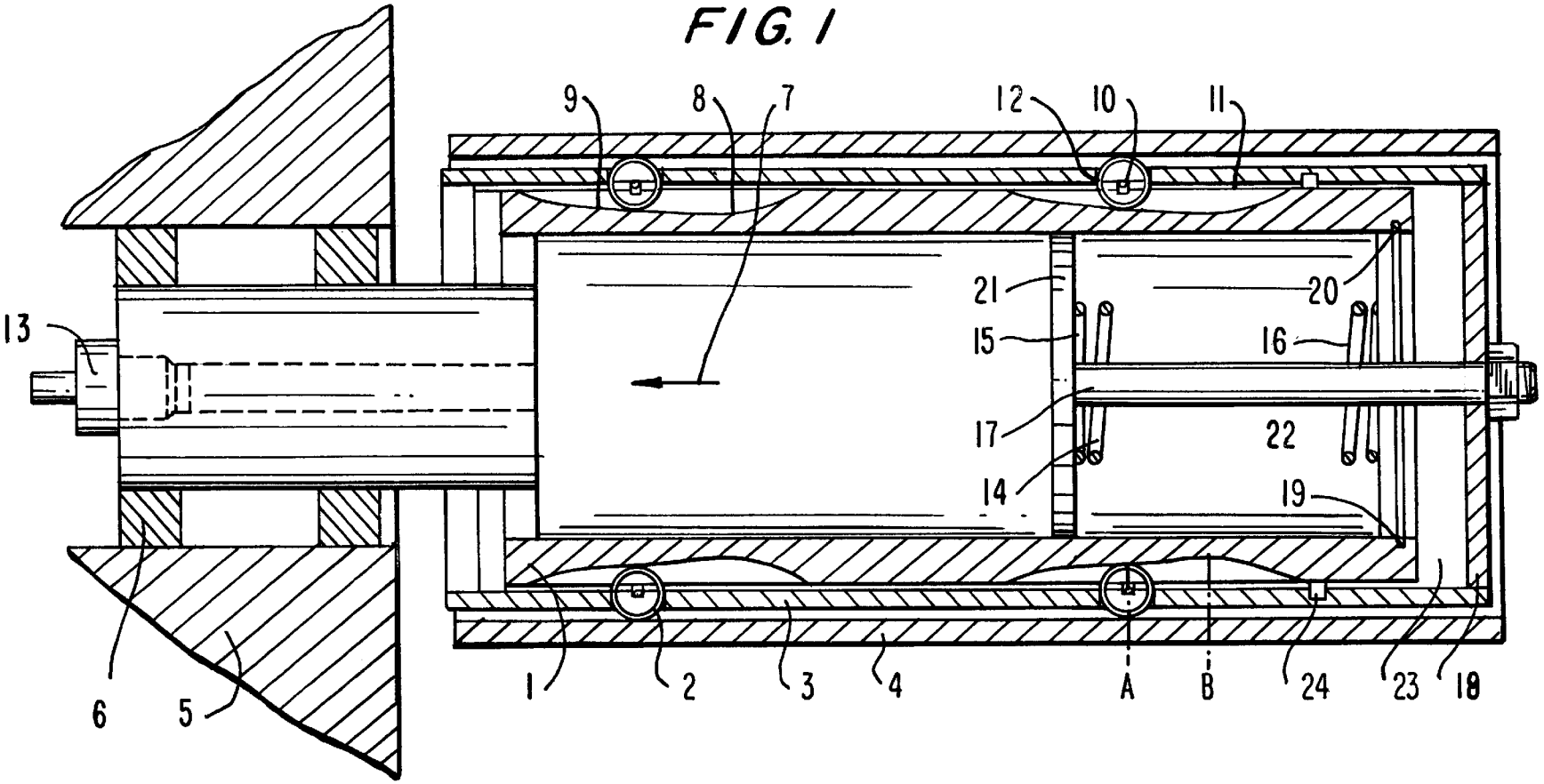
FIG. 1 is a view showing a horizontal section extending parallel to an axis of a coil holder in accordance with a first embodiment of the present invention, in which clamping elements are formed as hollow cylinders, and the coil holder is shown in a clamped condition with a sleeve.
Figure 2:
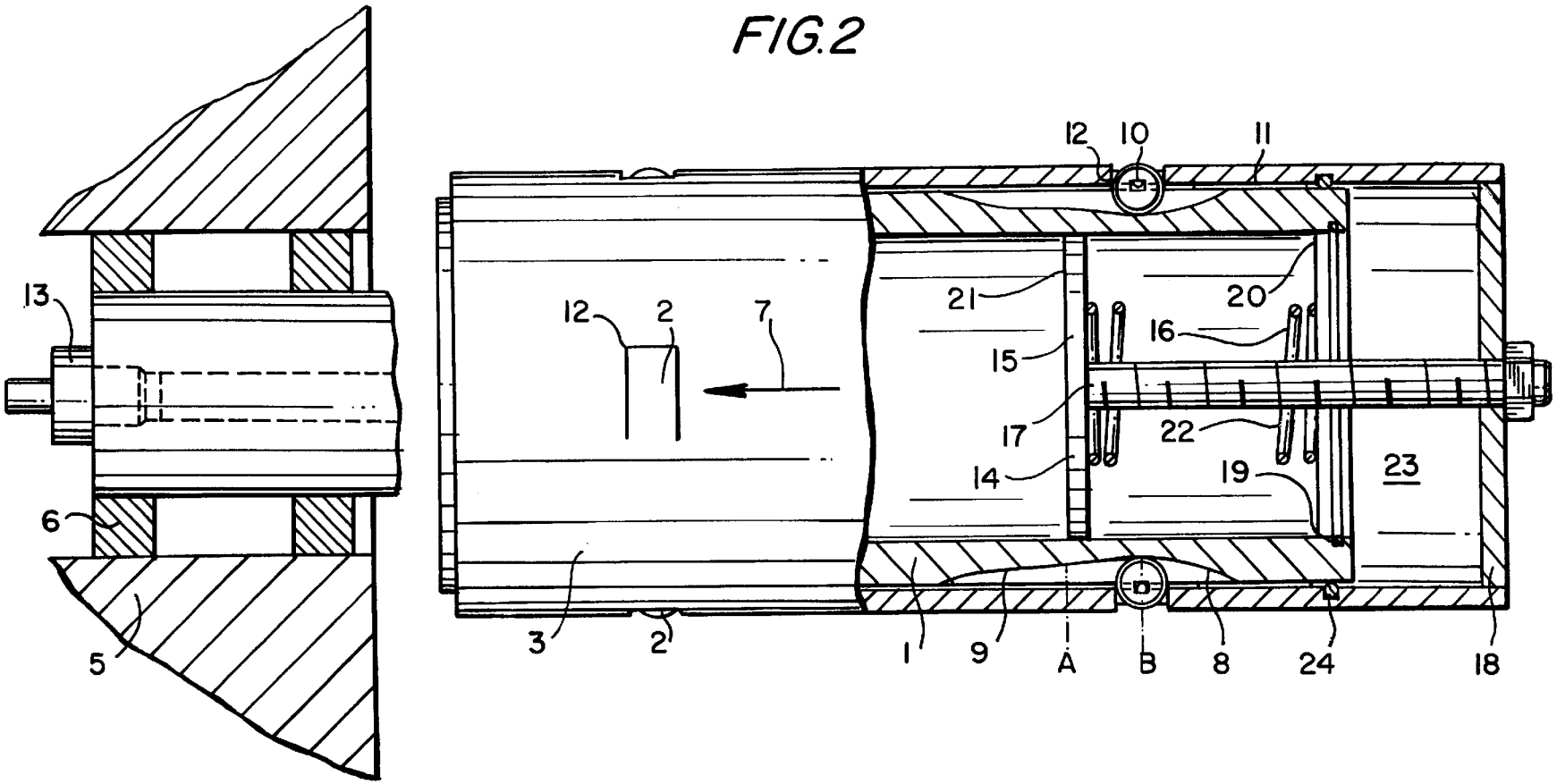
FIG. 2 is a view substantially corresponding to the view of FIG. 1, but showing the coil holder in unclamped condition without a sleeve.
Figure 3:
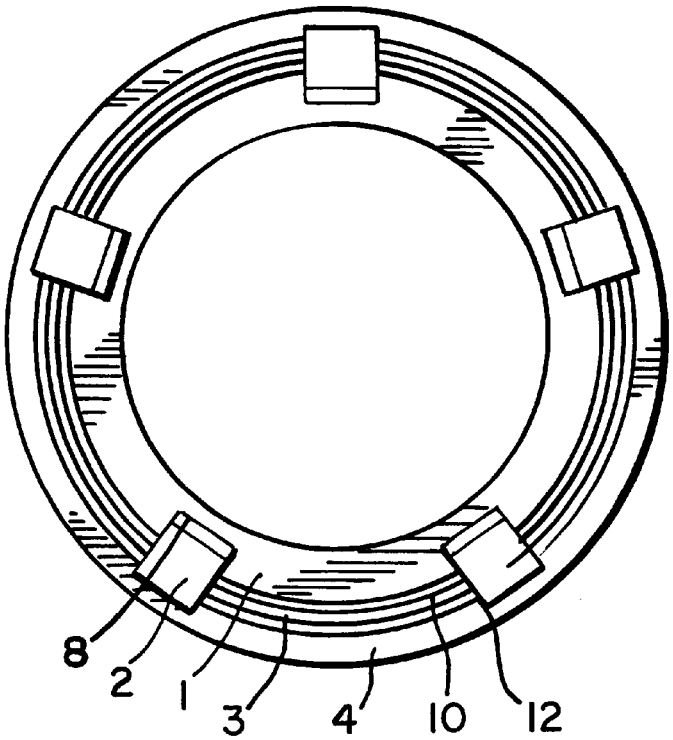
FIG. 3 is a view showing a vertical section extending perpendicular to an axis of a coil holder, with the coil holder in a clamped condition with a sleeve.
Figure 4:
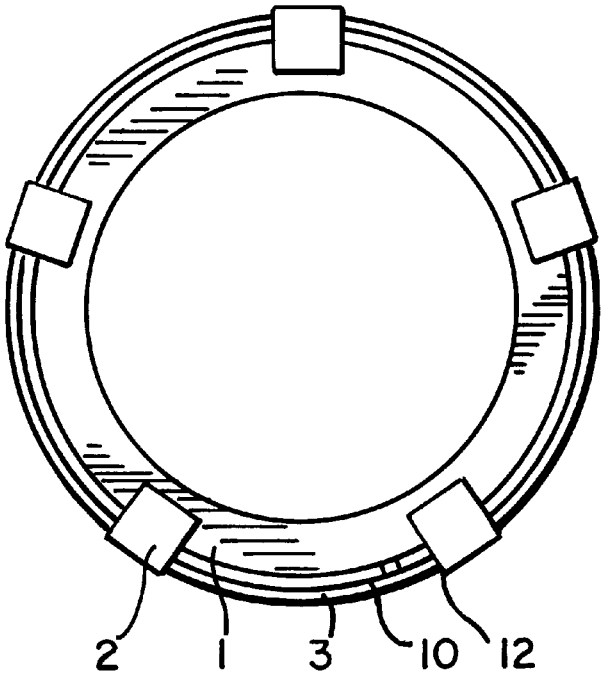
FIG. 4 is a view substantially corresponding to the view of FIG. 3, but showing the coil holder in unclamped condition without a sleeve.

FIGS. 1 and 3 show a sleeve 4 for winding a coil which surrounds the displacing pipe 3 in clamped condition.

The main pipe 1 extends with its end in a housing 5 and is rotatably supported there by a rotary bearing 6 arranged on its outer periphery.

The clamping elements 2 are distributed in several groups which are arranged axially one after the other, each on a circumferential line of the main pipe 1. The main pipe has corresponding recesses on its outer circumference, in which the clamping elements 2 are inserted. In this embodiment clamping elements distributed on a circumferential line of the main pipe 1 form a group. One group is composed of at least three clamping elements 2. For coils with greater inner diameter and corresponding sleeves 4, there can be 7, 9 or more clamping elements 2. The sleeve 4 is clamped by two groups of the clamping elements 2. For longer sleeves 4, also several groups, for example 20 groups for the sleeve 4 having a length of 1 m can be arranged on the main pipe 1 of the coil holder.

The recesses of the main pipe 1 are rectangular, and one side of the rectangle extends parallel to the rotary axis. The recesses are arranged also on a circumferential line of the main pipe 1. They are limited axially and in particular in a circumferential direction. Their abutment surfaces are flat in a circumferential direction and increase in the clamping direction represented by the arrow 7. The abutment surfaces have two portions 8 and 9 located one behind the other in an axial direction. The raise of the front portion 8 as considered in the clamping direction is greater than in a rear portion 9. In this embodiment, the front portion 8 in the clamping direction 7 is formed as a circular portion, while the rear portion 9 in the clamping direction 7 is formed as a linear raising portion.

The clamping elements 2 are composed of hollow cylinders, for example of tubular portions. The length of the tubular portions corresponds to the width of the recesses of the main pipe 1 in the circumferential direction with a movement gap, or in other words clearance fit provided between the clamping elements 2 and the recesses of the main pipe.

The clamping elements 2 extend, depending on the clamping position, by a third-half outwardly from the recesses. A safety wire 10 which is open at one side extends through the clamping elements 2 formed as tubular portions and is guided in a groove of the displacing pipe 3. The thin-walled displacing pipe 3 surrounds the main pipe 1 and is guided on sliding bearings 11, for example synthetic plastic bands. The displacing pipe 3 has openings 12 for the clamping elements. The openings 12 of the displacing pipe 3 are rectangular and arranged so that their one side is parallel to the rotary axis or in other words extends in an axial direction. Their size in the axial direction corresponds substantially to the diameter, and their size in a circumferential direction corresponds substantially to the length of the tubular portions which form the clamping elements 2.

A device for displacing the displacing pipe 3 has a pneumatic connection 13 with a rotary inlet at an end of the main pipe 1 supported in the housing 5, and a spring 14 mounted under tension and located between two parallel plates 15 and 16 arranged perpendicular to the rotary axis in the inner space of the main pipe 1. The plate 15 which faces the housing 5 is connected by a screw 17 with a cover 18 of the displacing pipe 3 which extends through the main pipe 1. The screw 17 is located in the center of the spring 14. The plate 16 facing away from the housing 5 is arranged on the end of the main pipe 1 and supported outwardly by a shaft safety ring 20 located in a groove 19. The pneumatic connection 13 is connected, for example by an opening in the portion of the main pipe 1 located in the housing in a massive construction, with the inner space of the main pipe 1. It is also connected through openings 21 in the plate 15 and the central opening 22 in the plate 16 with a pressure chamber 23 before the cover 18 of the displacing pipe 3. The pressure chamber 23 is formed by the part of the displacing pipe 3 extending over the main pipe 1. It is sealed by an O-ring 24 arranged at an outer end of the main pipe 1 between the main pipe 1 and the displacing pipe 3.

During the operation the spring 14 in the clamped condition expands. The pressure chamber 23 formed between the main pipe 1 and the displacing pipe 3 has correspondingly its smallest expansion. The spring 14 through the plate 15, the screw 17 and the cover 18 applies a force in the clamping direction in accordance with the arrow 7, to the displacing pipe 3. The clamping elements 2 are located on the portion 9 of the abutment surfaces of the recesses of the main pipe 1 in position A, which portion is rear in the clamping direction and raises linearly at a small angle. They are held by the front edges of the openings 12 of the displacing pipe 3 as considered in the clamping direction, exactly in their axial position and in their radial position.

For unclamping the coil holder, pressure air is supplied through the interior of the main pipe 1 into the pressure chamber 23. The pressure air displaces the cover 18 against the clamping direction. The plate 15 connected with the cover 18 by the screw 7 is displaced together with the cover against the clamping direction and the spring 14 supported against the plate 16 is compressed. The clamping elements are displaced by the rear edges of the openings 12 of the displacing pipe 3 as considered in the clamping direction, opposite to the clamping direction to the position B. Because of this axial displacement, the clamping elements 2 are moved radially inwardly. The sleeve 4 is withdrawn and a new sleeve 4 is moved onto the coil holder.

For new clamping, the pressure air is released through the pneumatic connection 13. The spring 14 expands and displaces the displacing pipe 3 in the clamping direction. The clamping elements 2 are displaced in the clamping direction with the displacing pipe 3. The clamping elements 2 which are formed as cylindrical tubular portions, roll on the supporting surfaces of the recesses of the main pipe 1 and are moved radially outwardly by the raise of the supporting surfaces. Due to the greater incline of the front portion 8 of the supporting surfaces, the clamping elements 2 are first extended for bridging the distance between the displacing pipe 3 until it reaches the unclamping position B and the sleeve 4 is moved radially outwardly over a short axial path. In the rear portion 9, a predetermined axial displacement is performed in form of a substantially small radial movement. The clamping position A is reached when the force of the spring 14 corresponds to the clamping force of all clamping elements 2. For longer coil holders, several displacing pipes 3 can be arranged axially one after the other. One displacing pipe 3 surrounds correspondingly at least two groups of the clamping elements 2. The displacing pipes are connected with one another axially rigid, for example by pins.

Figure 5:
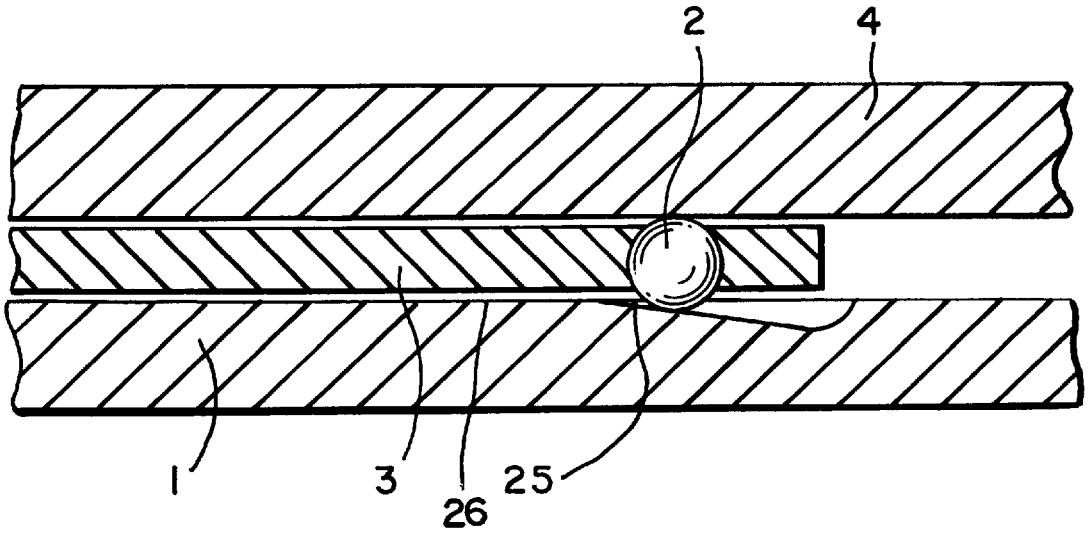
FIG. 5 is a view showing clamping elements in accordance with a second embodiment of the present invention, in a section in a clamped condition.
Figure 6:
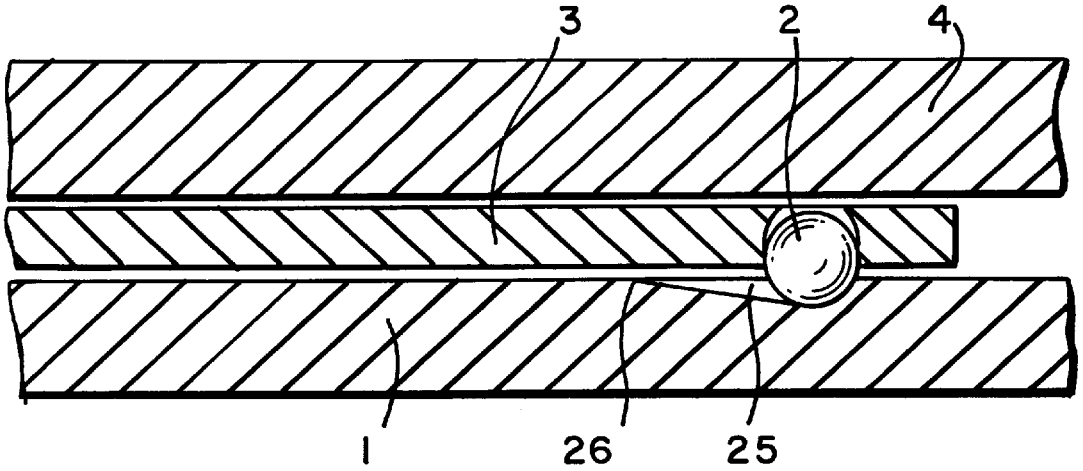
FIG. 6 is a view substantially corresponding to the view of FIG. 5 but showing an unclamped condition.

In the second embodiment shown in FIGS. 5 and 6, the clamping elements 2 are formed as balls. The diameter of the balls is not substantially greater than the thickness of the displacing pipe 3. Correspondingly, the recesses of the main pipe 1 for receiving the clamping elements 2 are less deep and smaller in the circumferential direction.

The openings 12 in the displacing pipe 3 are formed as cylindrical openings, and the diameter of the opening reduces in the outer region so that the outer diameter of the opening is smaller than the diameter of the ball. Thereby the displacing pipe 3 forms a collar 25 provided on each opening 12 and preventing falling out of the balls. Such a collar 25 can be also formed by a ring inserted in a ring groove on an outer end of the opening.

Instead of the sliding bearing 11, a clearance fit can be provided between the displacing pipe 3 and the main pipe 1, as identified with reference numeral 26 in FIGS. 5 and 6.

Figure 7:
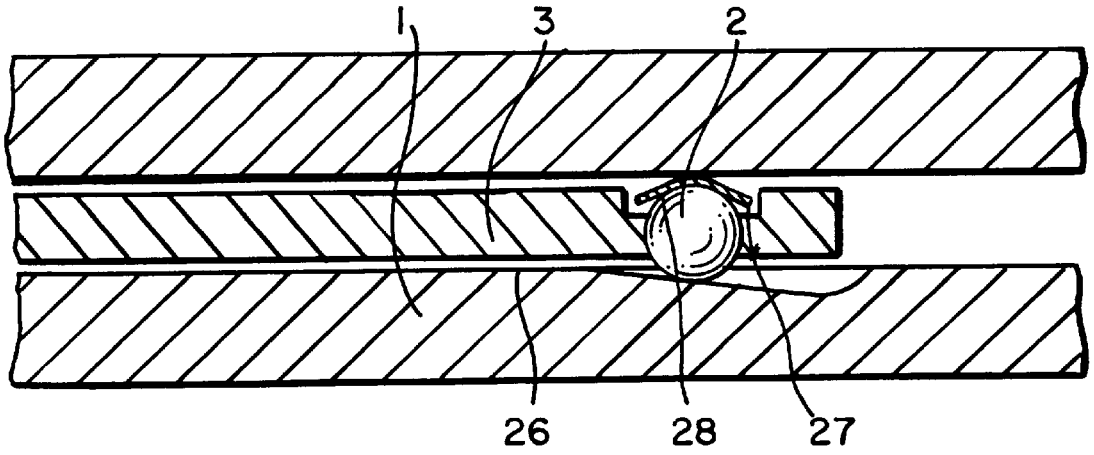
FIG. 7 is a view showing clamping elements in accordance with the third embodiment of the present invention in section in a clamped condition.
Figure 8:
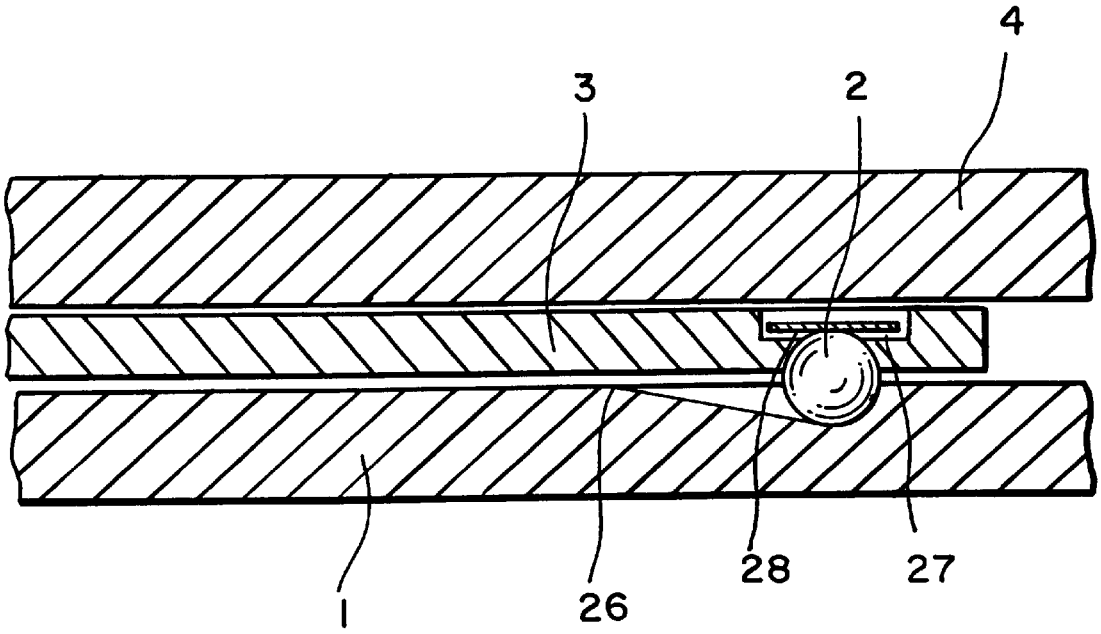
FIG. 8 is a view substantially corresponding to the view of FIG. 7 but showing the unclamped condition.

A third embodiment shown in FIGS. 7 and 8 corresponds to the second embodiment, with the exception of some differences. The displacing pipe 3 also has openings 12 formed as cylindrical openings. In addition, the displacing pipe 3 in the outer region of the openings is provided with a circumferential groove 27. The width of the circumferential groove 27 is greater than the diameter of the clamping elements 2 formed as balls. A flat metal ring 28 is located in the groove. In unclamped condition, the outer diameter of the metal ring 28 corresponds to that of the displacing pipe 3. In clamped condition, the metal ring 28 is deformed polygonally.

Figure 9:
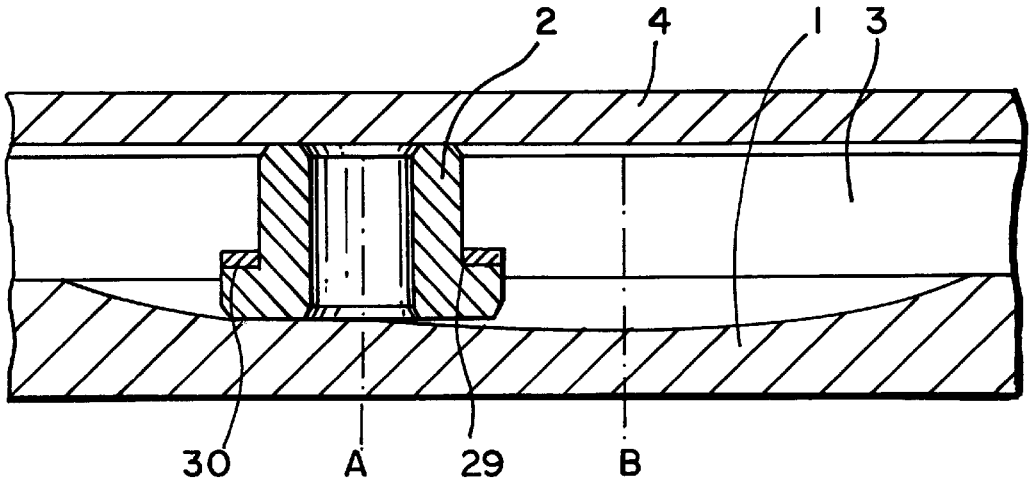
FIG. 9 is a view showing clamping elements in accordance with a fourth embodiment of the present invention, in section in a clamped condition.
Figure 10:
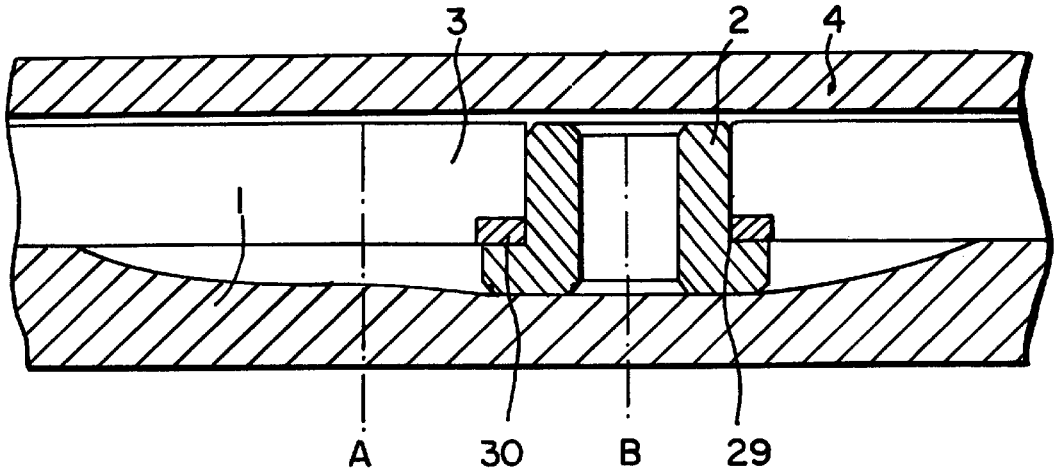
FIG. 10 is a view substantially corresponding to the view of FIG. 9 but showing an unclamped condition.

In the fourth embodiment shown in FIGS. 9 and 10, the clamping elements are formed as pins, or in other words as short, radially arranged tubular portions with an outer collar 29 facing the rotary axis. Such pins are known, for example as sliding bearings for shaft. The recesses of the main pipe 1 in which the clamping elements formed as pins are arranged correspond to the first embodiment. The depth of the recess substantially corresponds to the thickness of the collar 29 of the pin.

The openings 12 of the displacing pipe 3 are formed as cylindrical openings, and the diameter of the opening corresponds to the outer diameter of the pin. The openings have a greater diameter at the inner diameter of the displacing pipe 3. In the thusly formed ring groove at the openings 12, the collar 29 is inserted, when the clamping element 2 is moved radially outwardly for clamping by the axial displacement of the displacing pipe 3. In the clamping position A, the pins are arrested by the ring groove. Springs 30 are arranged between the collar 29 of the pin and the ring groove on the openings 12. They prevent moving out of the pins in the unclamped position B.

The coil holder of the fifth embodiment differs from the other embodiments in an arrangement for displacing the displacing pipe 3, formed as an ejecting plate 31 mounted on an ejecting rod 32. The ejecting plate 31 can be open on one side. Its inner diameter substantially corresponds to the inner diameter of the sleeve 4 and its thickness substantially corresponds to the thickness of a thick sleeve 4. Initially, the displacing pipe 3 at its end facing the housing 5 is provided with an outwardly projecting, ring-shaped collar 33. The thickness of the collar 33 corresponds to the ejecting plate 31. The ejecting plate 31 surrounds at least partially the displacing pipe 3 in the clamping direction before the collar 33. The mounting on the ejecting rod 32 is performed for example by a bracket. The ejecting rod 32 can be formed as an axial cylinder. It can be connected to a control device for arresting the ejecting rod and thereby the ejecting plate 31 in predetermined operational positions I, II and III.

The device for displacing the displacing pipe 3 also has arresting elements 34 inserted in the main pipe 1. The arresting elements 34 extend in two grooves 35 arranged one behind the other on the inner periphery of the displacing pipe 3 so that the arresting elements 34 in the clamping position A engage in the front groove 35 of the displacing pipe 3 as considered in the clamping direction of arrow 7 and the unclamping position engage in the rear groove 35. The arresting elements 34 are formed as small pressing pieces, for example flat springs, on which correspondingly a ball is mounted.

Figure 11:
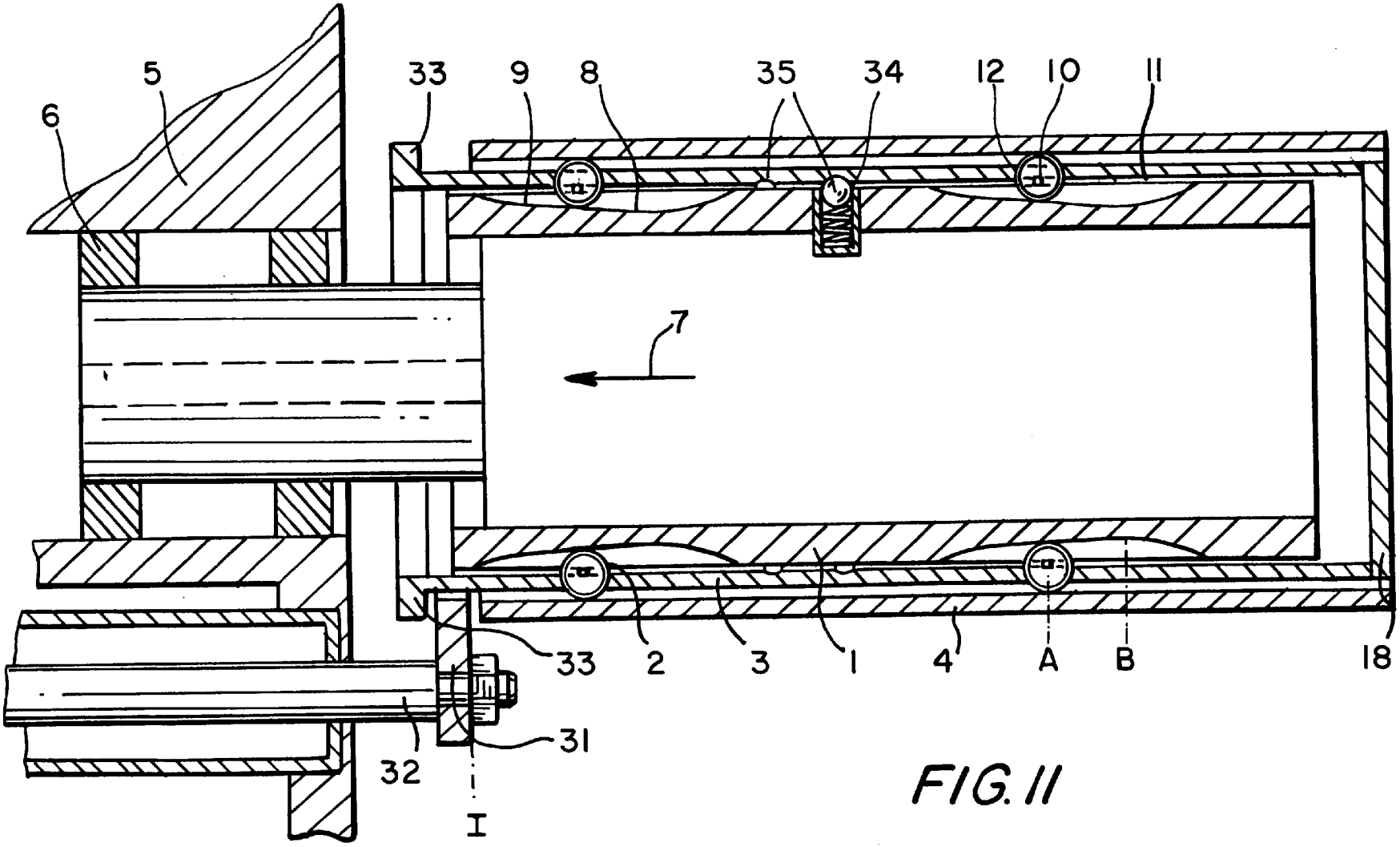
FIG. 11 is a view showing a fifth embodiment of the invention with the sleeve in a clamped condition.
Figure 12:
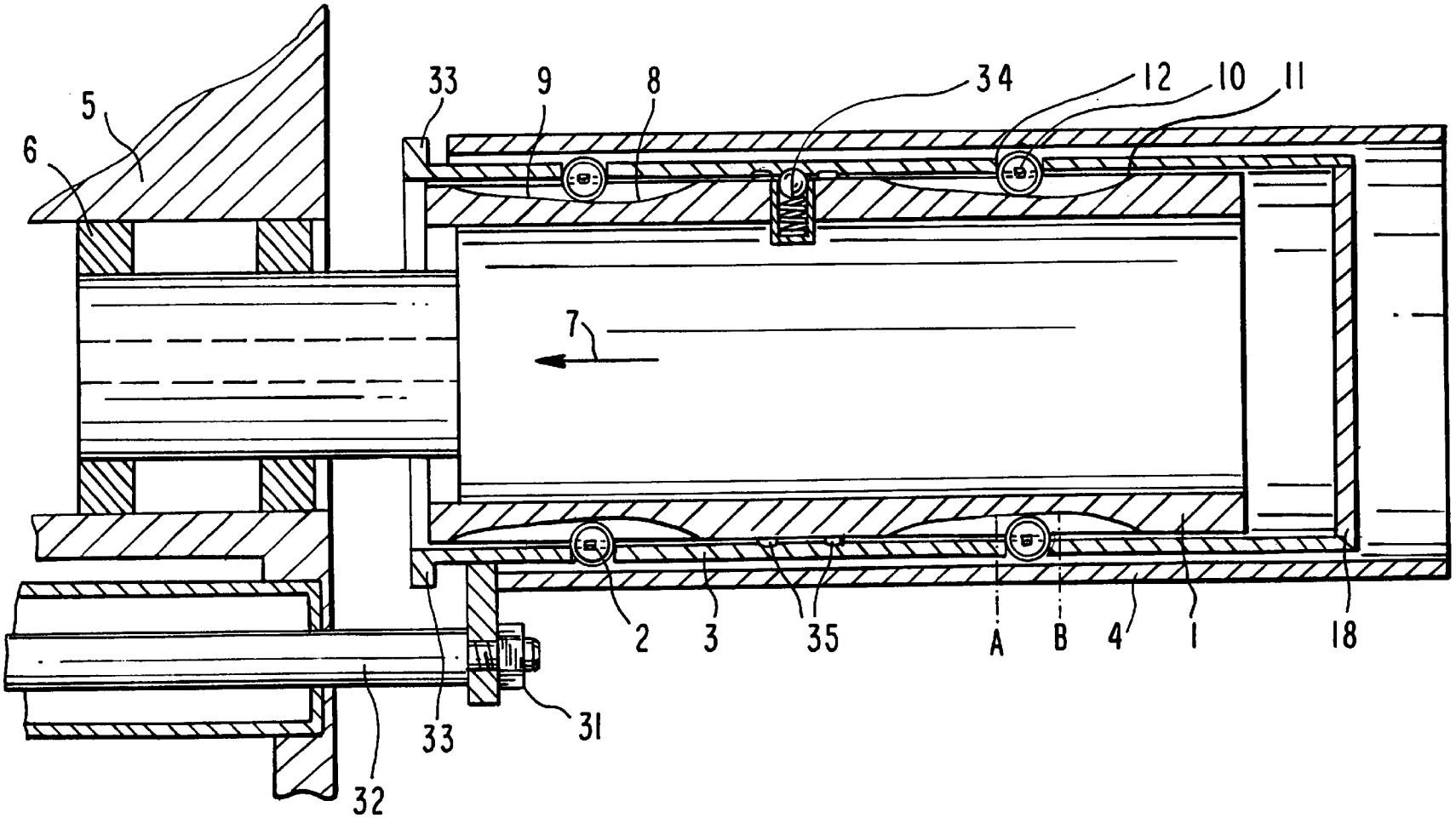
FIG. 12 is a view showing the fifth embodiment of the invention with the sleeve in an unclamped condition as the ejecting plate moves the sleeve opposite the clamping direction.
Figure 13:
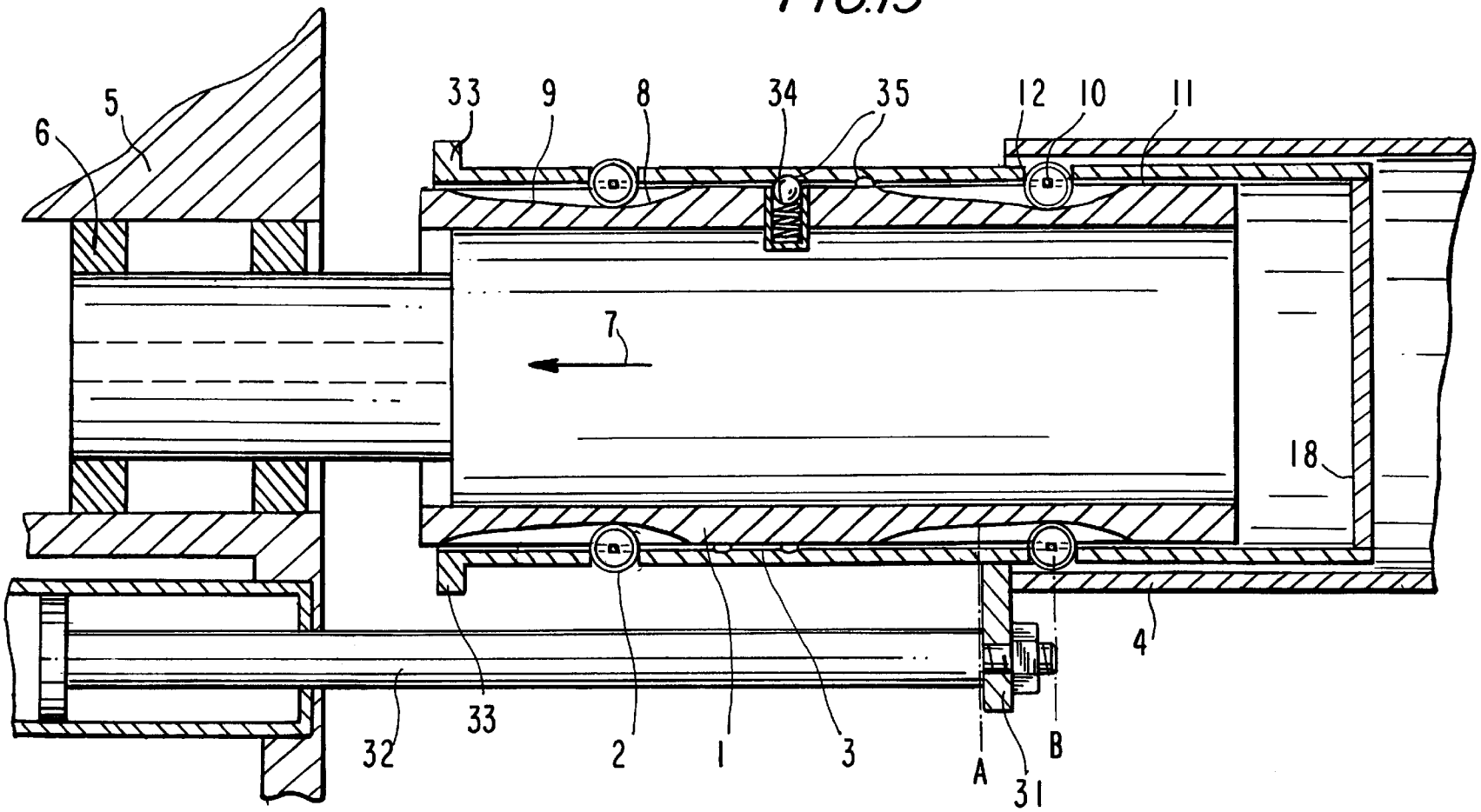
FIG. 13 is a view showing the fifth embodiment of the invention substantially as shown in FIG. 12 with the sleeve displaced further in the direction opposite the clamping direction.

During the operation in the clamped condition shown in FIG. 11, the displacing pipe 3 is arrested relative to the main pipe 1 by the arresting elements 34 in the front groove 35. The ejecting plate 31 is located in the operational position I, in which it is in contact neither with the collar 33 of the displacing pipe 3 nor with the sleeve 4. For unclamping, the ejecting plate 31 is displaced opposite to the clamping direction by the displacing rod 32, contacts the sleeve 4, and displaces the sleeve 4 also against the clamping direction. The sleeve 4 brings the clamping elements 2 and the displacing pipe until the clamping elements 2 loose the contact with the sleeve 4. After this, the sleeve 4 lies under its weight on the outer diameter of the displacing pipe 3 and brings the displacing pipe 3 axially to the unclamping position B.

Figure 14:
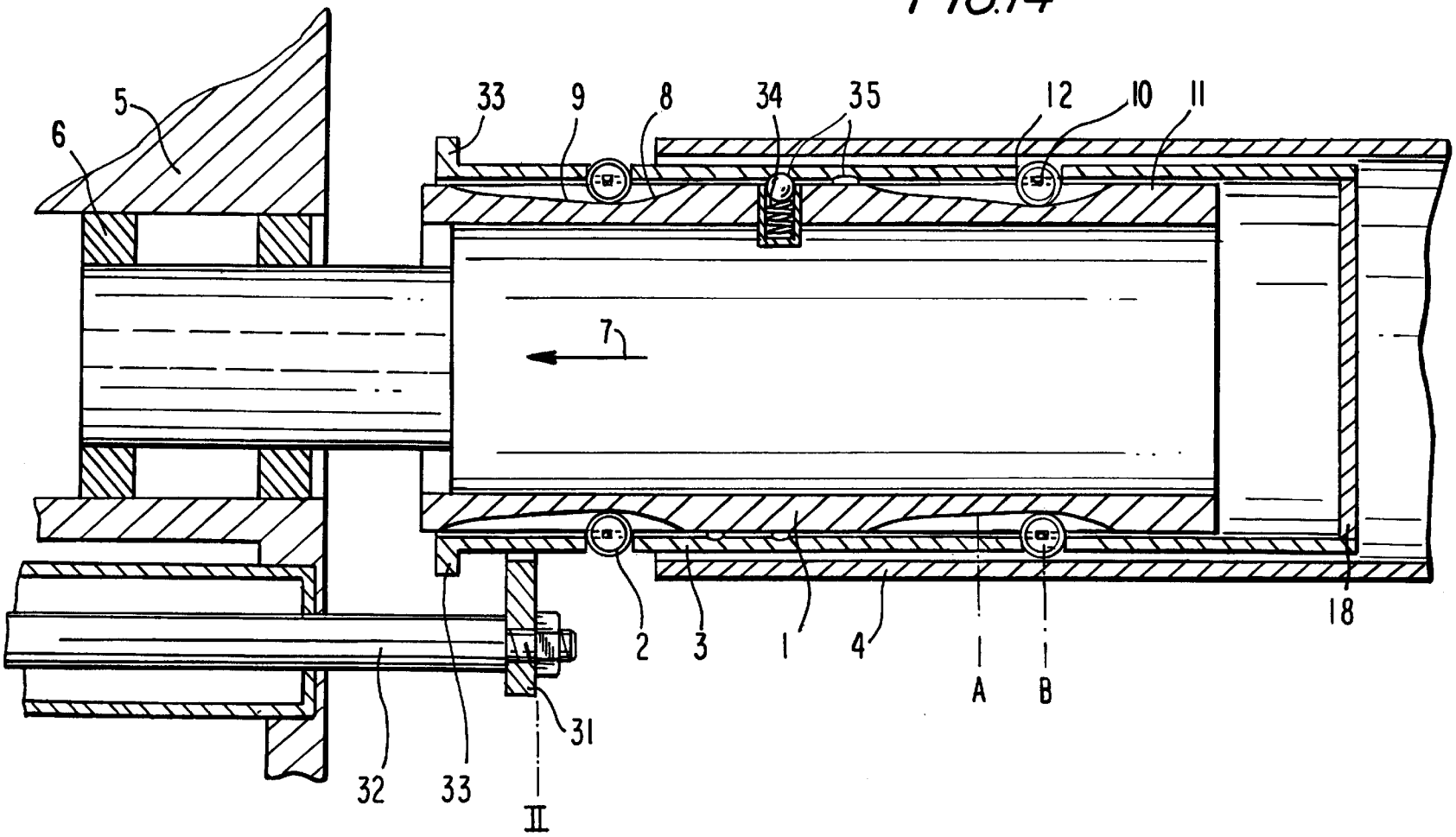
FIG. 14 is a view showing the fifth embodiment of the invention with the sleeve disposed around part of the coil holder as the sleeve is being clamped to the coil holder.
Figure 15:
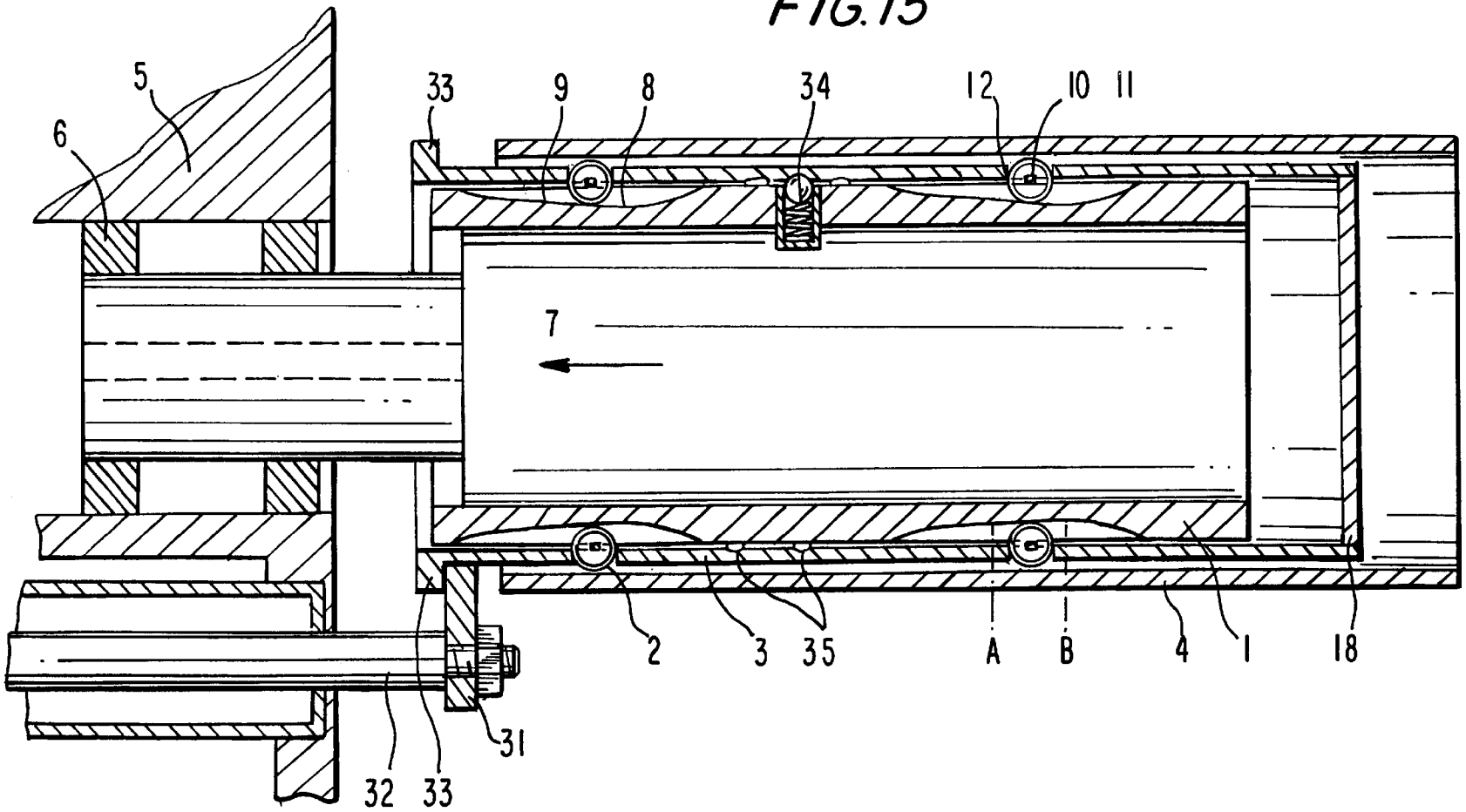
FIG. 15 is a view showing the fifth embodiment of the invention substantially as shown in FIG. 14 with the sleeve in a clamping position.
Figure 16:
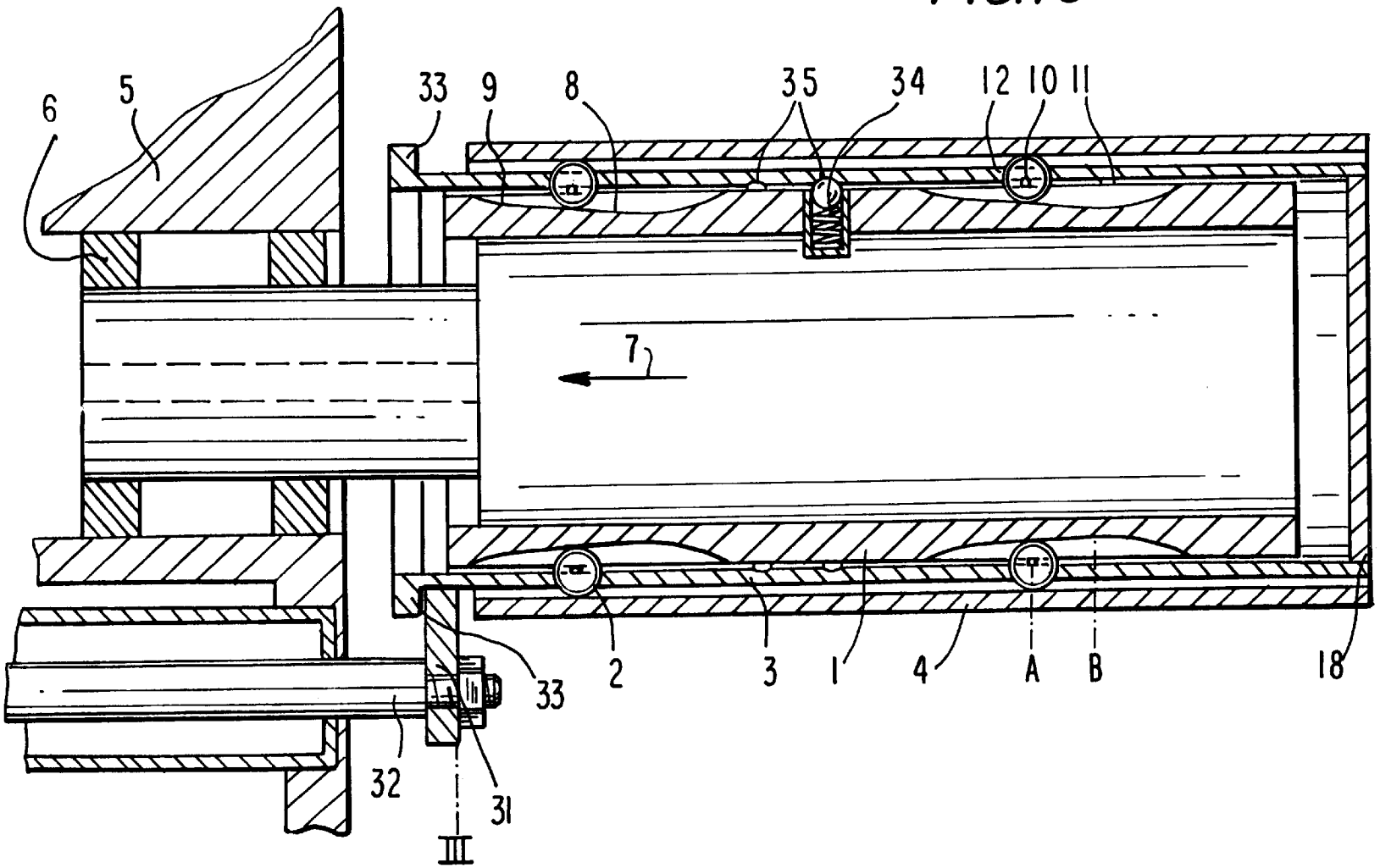
FIG. 16 is a view showing the fifth embodiment of the invention substantially as shown in FIG. 15 with the clamping elements being moved into engagement with the sleeve.

For clamping shown in FIG. 14, the ejecting plate 31 is arrested in the operational position II. The sleeve 4 is displaced against the ejecting plate 31 on the coil holder. Subsequently, the ejecting plate 31 is moved in the clamping direction of arrow 7. It acts on the collar 33 of the displacing pipe 3 and displaces the same axially in the clamping direction. Thereby the clamping elements 2 are moved first along the front portion A of the abutment surfaces of the recess of the main pipe 1. As long as they reach the rear portion 9, they contact the sleeve 4. A further displacement of the collar 33 of the displacing pipe 3 leads to clamping of the clamping elements 2 against the main pipe 1 and the sleeve 4 as well as simultaneous rolling of the clamping element. Thereby, the sleeve 4 is transportable very little in the clamping direction. In position III the clamping position A is provided as shown in FIG. 16.

It will be understood that each of the elements described above, or two or more together, may also find a useful application in other types of constructions differing from the types described above.

While the invention has been illustrated and described as embodied in coil holder for one or several coils, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A coil holder for at least one coil, comprising a main pipe provided with recesses forming abutment surfaces which are wedge-shaped in an axial direction of said main pipe and directly arranged on an outer periphery of said main pipe; a plurality of clamping elements arranged in groups so that said clamping elements of each one of said groups are distributed on a respective circumferential line of said main pipe and the groups of said clamping elements are located axially one behind another along said main pipe, said clamping elements being disposed in said recesses; at least one axially displaceable cylindrical displacing element surrounding said main pipe and provided with openings for said clamping elements; a device for displacing said displacing element relative to said main pipe, said displacing element being formed as a single, rigid displacing pipe which surrounds at least two of said groups of said clamping elements, said recesses of said main pipe having a width substantially equal to a width of said clamping elements, each of said abutment surfaces having a first portion and a second portion with said first portion being axially disposed with respect to said second portion along said main pipe and defining an engaging surface, and said second portion defining a disengaging surface wherein when said clamping elements are disposed on said engaging surfaces, said clamping elements extend at least partially through said openings for engaging said at least one coil.

2. A coil holder as defined in claim 1, wherein each of said clamping elements is generally cylindrical in shape and has a longitudinal axis which extends in a direction generally tangential to said outer periphery of said main pipe.

3. A coil holder as defined in claim 2, wherein a safety wire extends through said clamping elements of at least one of said groups of said clamping elements.

4. A coil holder as defined in claim 1, wherein said clamping elements comprise balls and at least one of said groups of said clamping elements includes a metal ring having an outer diameter substantially equal to an outer diameter of said displacing element.

5. A coil holder as defined in claim 1, wherein a slope of each of said disengaging surfaces is greater than a slope of each of said engaging surfaces.

6. A coil holder as defined in claim 1, wherein said clamping elements are formed as pins having collars disposed between said main pipe and said displacing element, each of said pins includes a spring located between a respective one of said collars and a corresponding ring groove at an edge of a respective one of said openings of said displacing element.

7. A coil holder as defined in claim 1, wherein said displacing element includes a housing end and a distal end, said housing end having a collar and wherein said device for displacing said displacing element having an ejecting plate disposed to engage said collar for moving said displacing element relative to said main pipe and having a ejecting rod for moving said ejecting plate.

8. A coil holder as defined in claim 7, wherein said device for displacing said displacing element includes arresting elements disposed in said main pipe for engaging grooves provided in an inner surface of said displacing element.

* * * * *